US008146840B2

(12) United States Patent
Nakazono et al.

(10) Patent No.: US 8,146,840 B2
(45) Date of Patent: Apr. 3, 2012

(54) ELECTROSTATIC PAINTING METHOD AND APPARATUS

(75) Inventors: Daisuke Nakazono, Tochigi (JP); Takashi Wakimoto, Tochigi (JP); Hiroki Matsunaga, Tochigi (JP); Kouichi Tanizaki, Tochigi (JP)

(73) Assignee: Honda Motor Co., Ltd., Tokyo (JP)

( * ) Notice: Subject to any disclaimer, the term of this patent is extended or adjusted under 35 U.S.C. 154(b) by 510 days.

(21) Appl. No.: 12/503,378

(22) Filed: Jul. 15, 2009

(65) Prior Publication Data

US 2010/0012743 A1 Jan. 21, 2010

(30) Foreign Application Priority Data

Jul. 16, 2008 (JP) ..... 2008-185411

(51) Int. Cl.
*B05B 5/00* (2006.01)

(52) U.S. Cl. ..... 239/690.1; 239/3; 239/DIG. 14

(58) Field of Classification Search ..... 239/3, 690.1, 239/692, 696, 67, 68, 69, 74, 305, DIG. 14; 118/627, 629, 630, 620, 621
See application file for complete search history.

(56) References Cited

U.S. PATENT DOCUMENTS

| | | | | |
|---|---|---|---|---|
| 4,771,729 | A * | 9/1988 | Planert et al. | 118/697 |
| 4,879,137 | A * | 11/1989 | Behr et al. | 427/475 |
| 4,932,589 | A * | 6/1990 | Diana | 239/3 |
| 5,102,045 | A * | 4/1992 | Diana | 239/3 |
| 5,288,525 | A * | 2/1994 | Diana | 427/475 |
| 5,328,093 | A * | 7/1994 | Feitel | 239/3 |

FOREIGN PATENT DOCUMENTS

JP 11-267560 10/1999

* cited by examiner

*Primary Examiner* — Davis Hwu
(74) *Attorney, Agent, or Firm* — Rankin, Hill & Clark LLP

(57) ABSTRACT

An electrostatic painting method is disclosed in which air inside a paint feed channel is expelled when a color for painting is changed. An electrically conductive paint is channeled into a discharge channel of a fluid pathway, and the flow rate of the paint is measured. The fluid pathway is provided, via a paint valve, to a color changing valve mechanism, and communicates with a paint cartridge. The changing valve mechanism is provided in a distant position relative to a painting gun. Electrically conductive paint is channeled through a paint feed channel, which extends from the color changing valve mechanism to the painting gun, and air inside the paint feed channel is expelled. The paint feed channel is then filled with the electrically conductive paint according to the value measured for the flow rate.

4 Claims, 9 Drawing Sheets

ELECTROSTATIC PAINTING METHOD AND APPARATUS

FIELD OF THE INVENTION

The present invention relates to an improvement in an electrostatic painting method and an electrostatic painting apparatus.

BACKGROUND OF THE INVENTION

A painting apparatus is disclosed in Japanese Patent Application Laid-Open Publication No. 11-267560 (JP 11-267560 A). In this painting apparatus, a painting gun is provided to a painting robot, wherein a color changing valve unit for switching paints and a paint cartridge filled with a paint are provided to an arm section of the painting gun. A paint whose usage frequency is high is supplied to the painting gun via the color changing valve unit, and a paint whose usage frequency is low is supplied to the painting gun from the paint cartridge.

The painting apparatus disclosed in JP 11-267560 A will be described below with reference to FIG. 9 hereof.

A painting apparatus 200 shown in FIG. 9 comprises a manipulator 201 of a painting robot; a painting gun 202 mounted on a distal end of the manipulator 201; a color changing valve unit 204 and a paint cartridge 206 mounted on the manipulator 201; and a paint feed device 208 connected to the color changing valve unit 204 via a plurality of paint feed tubes 207. Reference numeral 209 shows a first arm of the manipulator 201, and reference numeral 210 shows a second arm of the manipulator 201. The color changing valve unit 204 and the paint cartridge 206 are mounted on the second arm 210.

If, for example, the color changing valve unit 204 or the paint cartridge 206 are positioned a large distance away from the painting gun 202, then when air inside a paint feed channel between the color changing valve unit 204 (or the paint cartridge 206) and the painting gun 202 is expelled by filling the paint feed channel with paint from the color changing valve unit 204 or the paint cartridge 206, the speed at which the paint feed channel is filled will vary dramatically depending on the viscosity of the paint and the ambient temperature. As a result, when the filling speed increases, the amount of discarded paint increases, and the amount of paint required for painting may occasionally be insufficient.

Additionally, since the color changing valve unit 204 and the paint cartridge 206 are attached to the manipulator 201, the moment of inertia of the to manipulator 201 increases, and movements such as quick swiveling become difficult. Moreover, the power for operating the manipulator 201 also increases. Furthermore, the size of the moving part increases, which may make painting tasks harder to perform in a cramped place.

SUMMARY OF THE INVENTION

An object of the present invention is to provide an electrostatic painting method and an electrostatic painting apparatus whereby a fixed amount of paint is used when a paint feed channel is filled with paint in order to expel air, rapid operation of a painting robot can be performed, and painting tasks can also be readily conducted in a cramped place.

According to one aspect of the present invention, there is provided, in an electrostatic painting in which an electrically conductive paint is supplied from a plurality of paint feed sections to a color changing valve mechanism, a paint feed channel and a painting gun, a method for continuing the electrostatic painting with the electrically conductive paint changed to a separate electrically conductive paint of different color, comprising the steps of: switching a paint valve connected to the color changing valve mechanism such that a first pathway of the paint valve is placed in communication with a paint cartridge that is connected to the paint valve, and a second pathway of the paint valve is placed in communication with a discharging channel of a fluid pathway connected to the paint valve, the fluid pathway being shorter than the paint feed channel; discharging the electrically conductive paint from the paint cartridge into the discharging channel of the fluid pathway; measuring a rate at which the electrically conductive paint flows into the discharging channel; switching the paint valve so that the paint cartridge communicates with the paint feed channel via a third pathway of the paint valve; to and filling the paint feed channel with a specified quantity of the electrically conductive paint from the paint cartridge in accordance with a result of the flow rate measurement, in order to expel air from an interior of the paint feed channel.

Shortening the length of the fluid pathway from the paint cartridge to the discharging channel makes it less likely that factors such as viscosity and ambient temperature will affect the speed at which the electrically conductive paint is introduced, and improves the accuracy with which the flow rate of the electrically conductive paint is measured by flow rate measuring means. Thus, the quantity of electrically conductive paint to fill the paint feed channel can be determined very accurately based on a highly accurate paint flow rate measurement result, allowing the quantity of the electrically conductive paint used to fill the paint feed channel to be maintained at a constant level. In other words, when air is to be expelled during color changing, the quantity of the electrically conductive paint to be used to fill the paint feed channel with a long pathway can be estimated with a high degree of accuracy based on the flow rate measurement result, allowing the quantity of electrically conductive paint used to fill the paint feed channel to be maintained at a constant level.

According to another aspect of the present invention, there is provided an electrostatic painting apparatus, a paint feed channel for supplying an electrically conductive paint from a plurality of paint feed sections to a painting gun; a color changing valve mechanism for switching the color of the electrically conductive paint, the color changing valve mechanism being provided to the paint feed channel so as to connect to the paint feed sections; a reservoir, provided to the paint feed channel closer to the painting gun than the color changing valve mechanism, for temporarily storing the electrically conductive paint and propelling the stored electrically conductive paint towards the painting gun; an insulating section, provided to the paint feed channel, for electrically insulating the reservoir from the paint feed sections; and a fluid pathway provided to the color changing valve mechanism so as to face the paint feed sections, wherein the fluid pathway comprises: a paint valve connected to the color changing valve mechanism; a paint cartridge connected to the paint valve; a discharging channel capable of discharging the electrically conductive paint from the paint cartridge; and a flow rate measurement device for measuring the volume of flow of the electrically conductive paint when the electrically conductive paint flows through the discharging channel; the paint valve comprises: a first pathway connected to the paint cartridge; a second pathway connected to the discharging channel; and a third pathway connected to the color changing valve mechanism, the paint valve being capable of switching between a flow channel that flows from the paint cartridge to the discharging channel and a flow channel that flows from the paint cartridge to the color changing valve mechanism, and the fluid measuring device, when the color of the electrically conductive paint is to be switched, measures the flow rate of electrically conductive paint when a determination is to be made of the quantity of electrically conductive paint to fill the paint feed channel in order for air to be expelled from the paint feed channel.

Shortening the length of the fluid pathway from the paint cartridge to the discharging channel makes it less likely that factors such as viscosity and ambient temperature will affect the speed at which the electrically conductive paint is introduced, and improves the accuracy with which the flow rate of the electrically conductive paint is measured by a flow rate measuring device. Thus, the quantity of electrically conductive paint to fill the paint feed channel can be determined very accurately based on a highly accurate paint flow rate measurement result, allowing the quantity of the electrically conductive paint used to fill the paint feed channel to be maintained at a constant level.

In other words, using a flow rate measuring device to measure the volume of the electrically conductive paint that flows through a fluid pathway having a short length makes it possible to minimize the extent to which the speed at which the fluid pathway is filled will be affected by the viscosity of the electrically conductive paint and the ambient temperature, and improve the accuracy with which the volume in which the electrically conductive paint flows is measured. Therefore, when air is to be expelled during color changing the quantity of the electrically conductive paint to be used to fill the paint feed channel with a long pathway can be estimated with a high degree of accuracy based on the flow rate measurement result, allowing the quantity of electrically conductive paint used to fill the paint feed channel to be maintained at a constant level.

Preferably, the fluid pathway further comprises a stopping valve provided between the flow rate measuring device and the discharging channel. Accordingly, the stopping valve can prevent the paint from being discharged through the discharging channel, even when the paint leaks from the paint valve.

Desirably, the painting gun is held by a painting robot, wherein a paint cartridge installation section is provided to a base that is provided to the painting robot, and the paint cartridge is detachably installed in the paint cartridge installation section. Thus, since the paint cartridge is not provided to a head, arm, or other moving part of the painting robot, the moment of inertia of the moving part of the painting robot is reduced, the accuracy with which the painting gun is positioned is increased, the painting gun can be moved swiftly and precisely, and the amount of power required can be reduced. It is also possible to reduce the size of the moving part of the painting robot, allowing the painting task to be readily performed without obstruction, even when a cramped place such as an interior of an automotive vehicle is being painted.

BRIEF DESCRIPTION OF THE DRAWINGS

A preferred embodiment of the present invention will be described in detail below, by way of example only, with reference to the accompanying drawings, in which.

DETAILED DESCRIPTION OF THE PREFERRED EMBODIMENT

Figure 1:
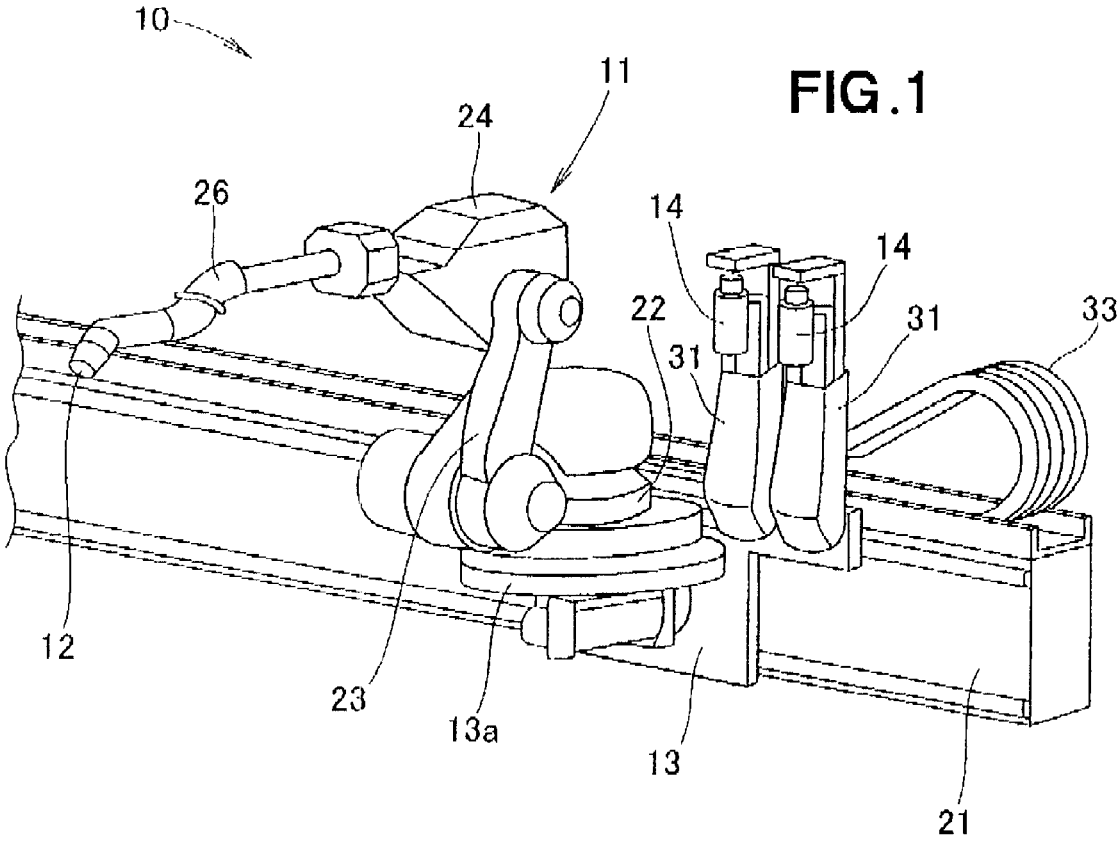
FIG. 1 is a perspective view illustrating an electrostatic painting apparatus including a painting robot, according to an embodiment of the present invention.

As shown in FIG. 1, an electrostatic painting apparatus 10 comprises a painting robot 11, which is slidably mounted on a support rail 21.

The painting robot 11 comprises a base 31 mounted slidably on the support rail 21; a rotating section 22 rotatably mounted on a table 13*a* provided to the base 13; a first arm 23 swingably mounted on the rotating section 22; a head 24 swingably mounted on a distal end of the first arm 23; a second arm 26 mounted on a front end of the head 24; and a painting gun 12 mounted on a distal end section of the second arm 26.

Figure 2:
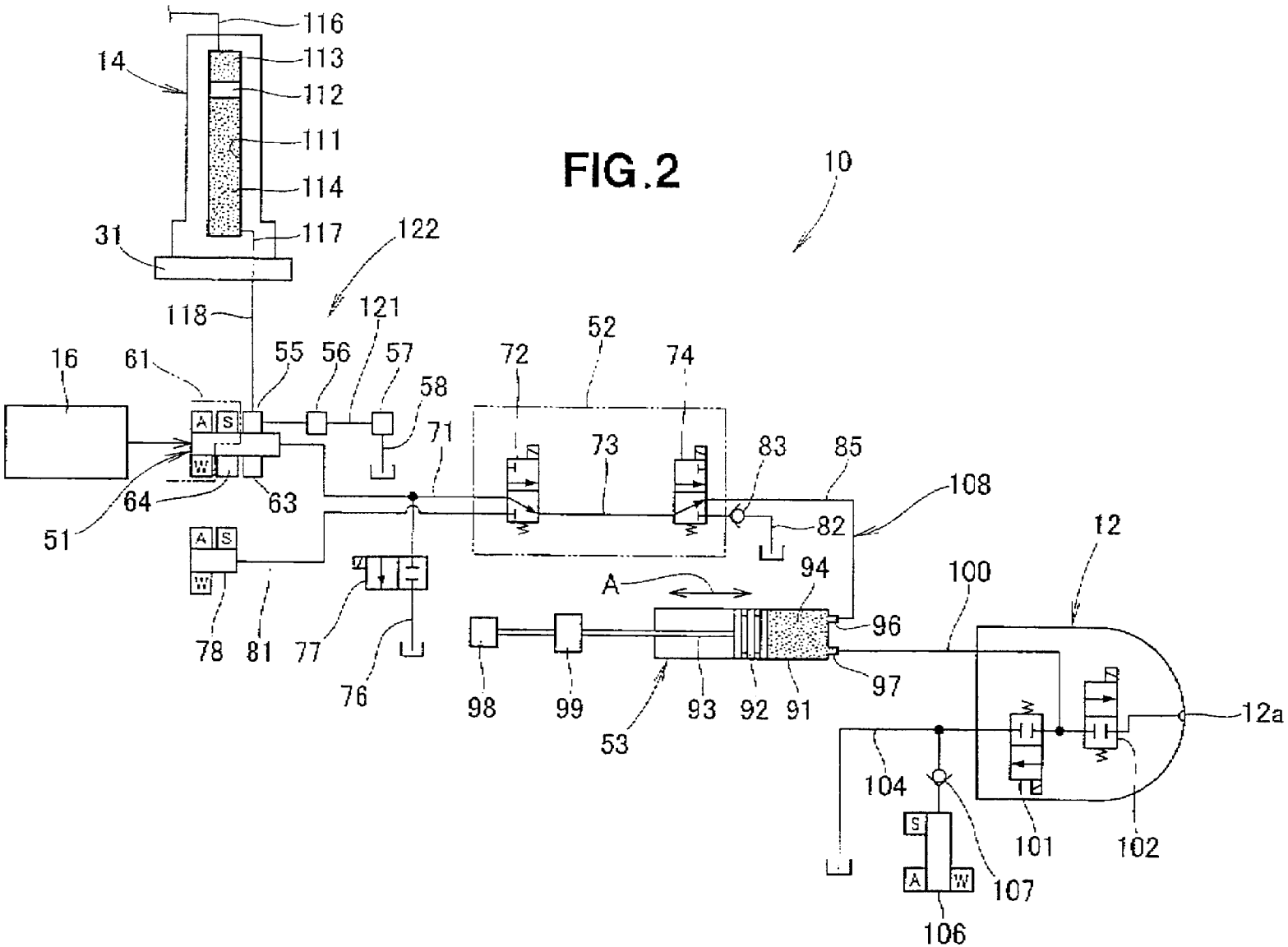
FIG. 2 is a schematic drawing showing the electrostatic painting apparatus of FIG. 1.

A plurality of paint cartridges 14 are detachably installed in a cartridge installation section 31, which is itself mounted on the base 13, and are connected to a color changing valve mechanism 51 (FIG. 2) provided to the painting robot 11, via a paint valve 63 (FIG. 2).

A top section of the support rail 21 supports a tube bundle 33 that comprises a plurality of paint feed tubes, each of whose ends being connected to a paint feed section 16 (FIG. 2). The other end of the tube bundle 33 is connected to the color changing valve mechanism 51 of the painting robot 11.

As shown above, the paint cartridge installation section 31 is provided to the base 13 of the painting robot 11, and the paint cartridge 14 is detachably installed in the paint cartridge installation section 31, the paint cartridge 14 not being provided to a moving part such as the head 24 or the arms 23, 26 of the painting robot 11. As a result, the moment of inertia of the moving part of the painting robot 11 is reduced, the accuracy with which the painting gun 12 is positioned is increased, the painting gun can be moved swiftly and precisely, and the amount of power required can be reduced. It is also possible to reduce the size of the moving part of the painting robot 11, allowing the painting task to be readily performed without obstruction, even when a cramped place such as an interior of an automotive vehicle is being painted.

As shown in FIG. 2, the electrostatic painting apparatus 10 comprises: the color changing valve mechanism 51, which is connected to a plurality of paint feed sections 16 supplying a plurality of electrically conductive paints of different color, and used for switching supply of the electrically conductive paint; a block valve mechanism 52 for electrically insulating the color changing valve mechanism 51 in the direction of the painting gun 12; a storage tank 53 for temporary storing the electrically conductive paint, the storage tank 53 being connected to the block valve mechanism 52; the painting gun 12 for spraying the electrically conductive paint onto an automotive vehicle or other object to be painted; a fluid pathway 122 connected to the color changing valve mechanism 51; and the paint cartridge 14 connected to the fluid pathway 122.

The color changing valve mechanism 51 comprises a first cleaning valve 61 for controlling the supply of drying air A, water W, and a cleaning liquid S; and a plurality of paint valves 63, 64 for controlling the supply of electrically conductive paint from a plurality of paint feed sections 16 that supply electrically conductive paints of different color.

The block valve mechanism 52 comprises a first switching valve 72 connected to the color changing valve mechanism 51 via a feed channel 71 and a second switching valve 74 connected to the first switching valve 72 via a feed to channel 73 that is an electrically insulated duct channel made of a plastic material.

A first discharging channel 76 is connected to the feed channel 71 via a first dump valve 77. A second cleaning valve 78 is connected to the first switching valve 72 via a feed channel 81 and controls the supply of the air A, water W and cleaning liquid S. A second discharging channel 82 is connected to a second switching valve 74 via a one-way valve 83.

The first switching valve 72 switches between the direction of the color changing valve mechanism 51 and the direction of the second cleaning valve 78. The second switching valve 74 switches the connection of the feed channel 73 between the direction of a feed channel 85 and the second discharging channel 82.

The storage tank 53 comprises a cylinder 91, a piston 92 movably disposed within the cylinder 91, a rod 93 mounted to the piston 92, a cylinder chamber 94 described by the cylinder 91 and the piston 92, and an inlet 96 and an outlet 97 provided to an end section of the cylinder 91 and in communication with the cylinder chamber 94.

A rod 93 is connected to a servo motor 98 via ball screw means 99. Driving the servo motor 98 causes the rod 93 and the piston 92 to move in the direction of the cylinder axis (the direction of arrow A), via the ball screw means 99.

The painting gun 12 has a trigger valve 102, a second dump valve 101 connected to the outlet 97 of the storage tank 53 via a delivery channel 100, and an ejection hole 12*a* that is an end section of the delivery channel 100; and is connected to high-voltage-impressing means (not shown). The trigger valve 102 controls the ejection of electrically conductive paint from the painting gun 12.

The second dump valve 101 is connected to a third discharging channel 104 for discharging waste fluid from the delivery channel 100, the waste fluid being generated during cleaning and including electrically conductive paint and cleaning liquid. The third discharging channel 104 is connected, via a one-way valve 107, to a third cleaning valve 106 that controls the supply of the air A, water W, and cleaning liquid S.

The feed channels 71, 73, 85, storage tank 53 and the delivery channel 100 constitute a main feed channel 108 that extends from the paint feed section 16 to the painting gun 12.

The paint cartridge 14 has a cylinder hole 111; a free piston 112 movably disposed within the cylinder hole 111; a fluid channel 116 that connects a fluid chamber 113 to a source of supply of fluid such as water or air (not shown), the interior of the cylinder hole 111 being divided into the fluid chamber 113 and a paint chamber 114 by the free piston 112; and a paint channel 117 that connects the paint chamber 114 within the cylinder hole 111 to the cartridge installation section 31. The cartridge installation section 31 and the fluid pathway 122 (i.e., a paint valve 55, described later) are connected by a feed channel 118.

The paint cartridge 14 is filled with enough electrically conductive paint for 2 to 6 vehicles. The paint is applied by the painting robot 11 (shown in FIG. 1) to an interior of an engine compartment, where an engine hood and a fender section of a body of a passenger vehicle (not shown) or a motorcycle (not shown) meet, a body section where a door and the body meet, or similar sections, the parts such as the engine hood or the door being in an attached state.

The paint cartridge 14 is installed in a side opposite the side of the painting gun 12 as viewed from the color changing valve mechanism 51 provided to the painting robot 11. As a result, the moment of inertia of the moving part of the painting robot 11 is reduced.

The amount of electrically conductive paint inside the paint cartridge 14 decreases as more vehicles are painted. Therefore, in contrast to instances where the paint cartridge is installed in an arm or other moving part of the painting robot 11, in the present embodiment fluctuations in the moment of inertial of the moving part of the painting robot 11 are eliminated, the accuracy with which the painting gun is positioned is increased, the painting gun can be moved swiftly and precisely, and the amount of power required can be reduced. (The present embodiment is) suitable for painting cramped locations such as the interior of the engine compartment or a body section where a door and body meet; i.e., a pillar section, a door hinge section, or the like.

The paint valve 55 connected to the color changing valve mechanism 51, a phototube 56 connected to the paint valve 55, a stopping valve 57 connected to the phototube 56, and a discharge channel 58 connected to the stopping valve 57 are provided to the fluid pathway 122.

The paint valve 55 has a pathway (first pathway) connected to the paint cartridge 14, another pathway (second pathway) connected to the discharge channel 58 of the fluid pathway 122, and another pathway (third pathway) connected to the color changing valve mechanism 51. The paint valve 55 can switch between a flow channel through which the electrically conductive paint from the paint cartridge 14 flows to the discharge channel 58, and a flow channel through which the electrically conductive paint from the paint cartridge 14 flows to the color changing valve mechanism 51.

The phototube 56 measures the amount (and rate) at which the electrically conductive paint fills the fluid pathway 122.

Since the total length of the fluid pathway 122 is less than that of the paint feed channel, the flow of the electrically conductive paint through the fluid pathway 122 is less susceptible to the effect of the viscosity of the electrically conductive paint or the ambient temperature than when the electrically conductive paint is made to flow through, for example, the feed channel 71 of the paint feed channel; and the accuracy with which the flow rate of the electrically conductive paint is measured by the phototube 56 is improved.

The stopping valve 57 prevents the electrically conductive paint from being discharged to the discharge channel 58 even if the electrically conductive paint leaks out in the direction of the discharge channel 58 when the flow channel is being switched by the paint valve 55 to the pathway from the paint cartridge 14 to the color changing valve mechanism 51.

The feed channel 118 is included in the fluid pathway 122.

When the paint feed channel is being filled with the electrically conductive paint to expel air therefrom in order, e.g., to change the color of the electrically conductive paint being ejected from the painting gun 12 to another color, the time taken for filling varies significantly depending on the viscosity of the paint or the ambient temperature, because there is a great distance between the paint cartridge 14 and, for example, the first switching valve 72 of the paint feed channel. Therefore, by first making the electrically conductive paint flow from the paint cartridge 14 to the discharge channel 58, and using the phototube 56 to measure the flow (rate) of the electrically conductive paint, the time required to fill the paint feed channel with the electrically conductive paint can be determined with a high degree of accuracy based on the result of the flow rate measurement.

The operation of the electrostatic painting apparatus 10 will now be described.

Figure 3:
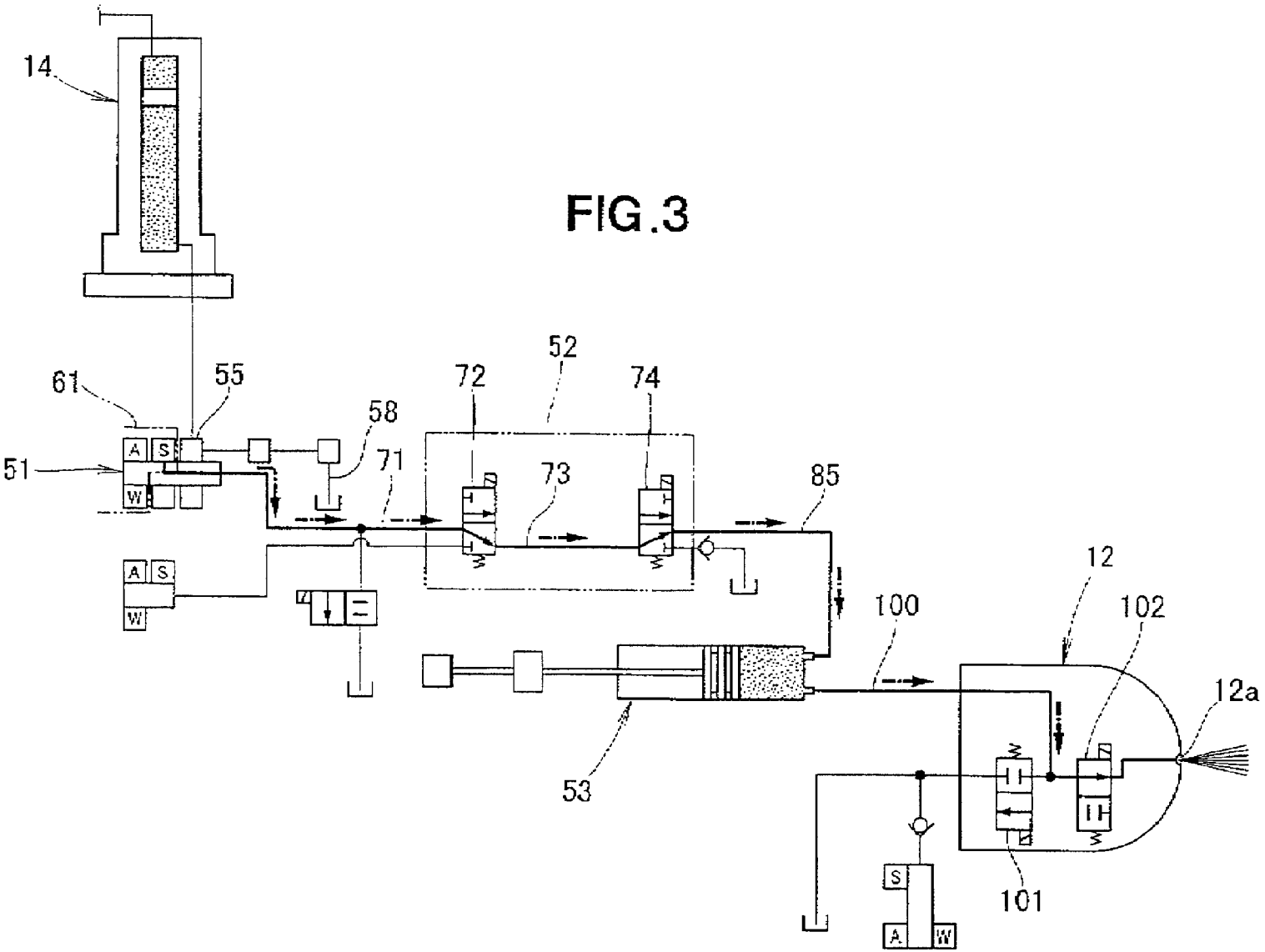
FIG. 3 is a view showing a state in which the paint feed channel of FIG. 2 is being cleaned.

FIG. 3 shows the paint feed channel of the electrostatic painting apparatus being cleaned.

First, the first cleaning valve 61 of the color changing valve mechanism 51 is opened and cleaning liquid S is directed into the paint feed channel in the direction indicated by the dotted arrow. This is performed in a state wherein the first and second switching valves 72, 74 of the block valve mechanism 52 are opened, the pathway at the paint valve 55 switched to the direction of the discharge channel 58, the pathway between the paint cartridge 14 and the color changing valve mechanism 51 is blocked, the second dump valve 101 is closed, and the trigger valve 102 is opened. As a result, the interior of the color changing valve mechanism 51, the feed channels 71, 73, 85, the interior of the storage tank 53, the delivery channel 100, and the interior of the painting gun 12 will be cleaned by the cleaning liquid S. The cleaning liquid S is discharged from the ejection hole 12*a*.

Figure 4:
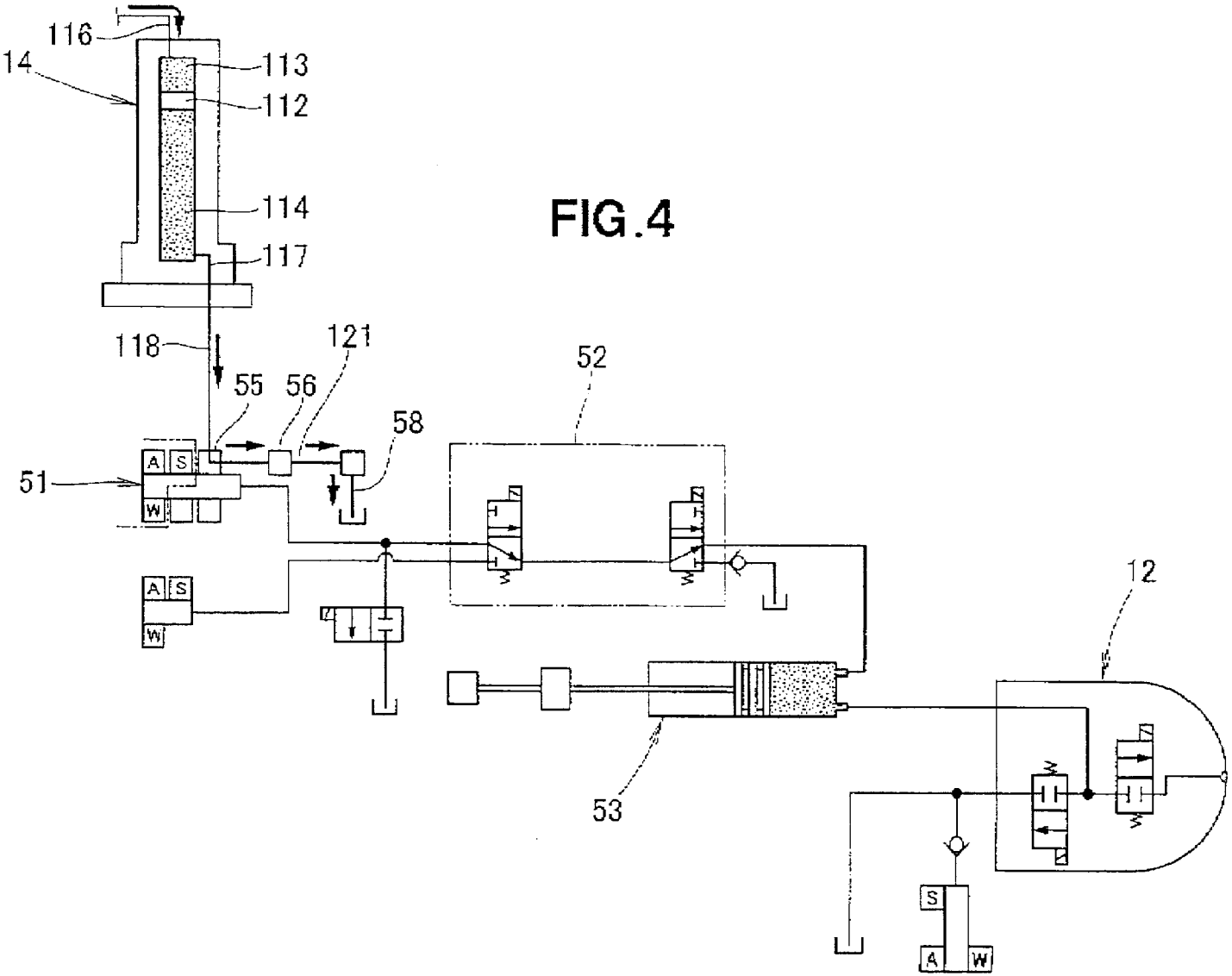
FIG. 4 is a view showing a state in which the volume of flow of an electrically conductive paint is measured, conducted before expelling air from the paint feed channel.

FIG. 4 shows a state in which the volume of flow of an electrically conductive paint is measured, conducted before the air is expelled from the paint feed channel.

Water or air is supplied to the fluid chamber 113 of the paint cartridge 14 via the fluid channel 116; the free piston 112 is moved so as to compress the electrically conductive paint inside the paint chamber 114; and the electrically conductive paint is channeled to a flow channel 121 via the paint channel 117, the feed channel 118, and the paint valve 55. As a result, the flow rate of the electrically conductive paint; i.e., the speed at which the flow channel 121 is being filled, is measured by the phototube 56, and the electrically conductive paint flows to the direction of the discharge channel 58. The result of the flow rate measurement performed using the phototube 56 is recorded in a memory section (not shown), together with the viscosity of the electrically conductive paint and the ambient temperature.

Figure 5:
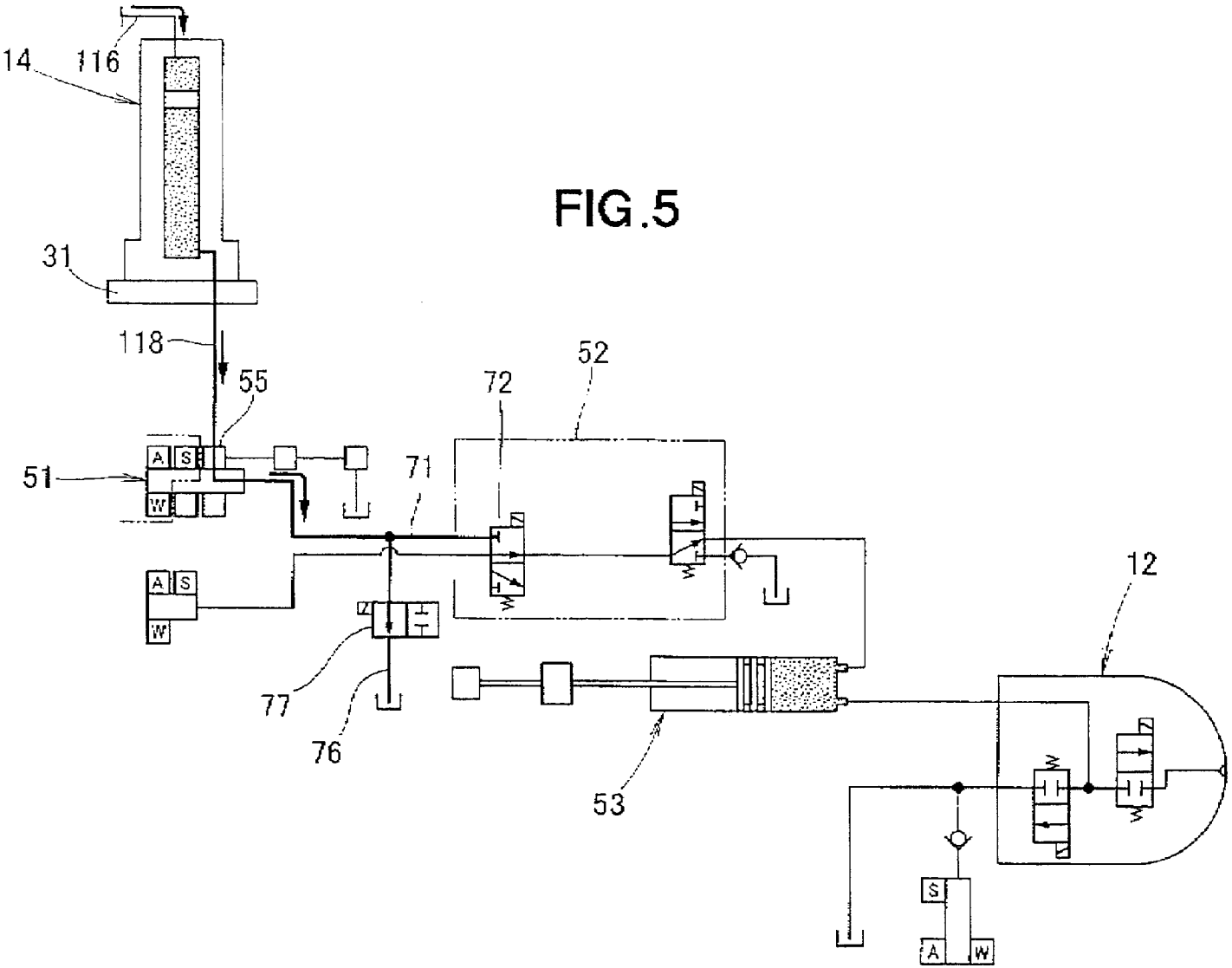
FIG. 5 is a view showing a state in which air is expelled from the paint feed channel.

FIG. 5 shows a state in which air is expelled from the paint feed channel.

After the flow rate of the electrically conductive paint has been measured as shown in FIG. 4, the electrically conductive paint is supplied from the paint cartridge 14 to the feed channel 71 via the color changing valve mechanism 51, and air is expelled from the color changing valve mechanism 51 and the feed channel 71.

At this time, the first switching valve 72 is closed, the first dump valve 77 is opened, and the supply of paint is terminated after a specified time once paint starts to be supplied from the paint cartridge 14. The specified time is determined based on the measurement of the flow rate of the electrically conductive paint as shown on FIG. 4 and the length of the paint feed channel.

As a result, the color changing valve mechanism 51 and the feed channel 71 are filled with the electrically conductive paint. The introduced paint is discharged from the first discharging channel 76 in an amount equating to the difference with respect to the amount obtained based on the result of the measurement of the flow rate of the paint.

The electrically conductive paint is thus supplied to the paint feed channel based on the results of the measurement of the flow rate of the electrically conductive paint; therefore, the paint feed channel can be filled very accurately with an amount of the electrically conductive paint, and the electrically conductive paint inside the paint cartridge 14 does not have to be wasted.

Figure 6:
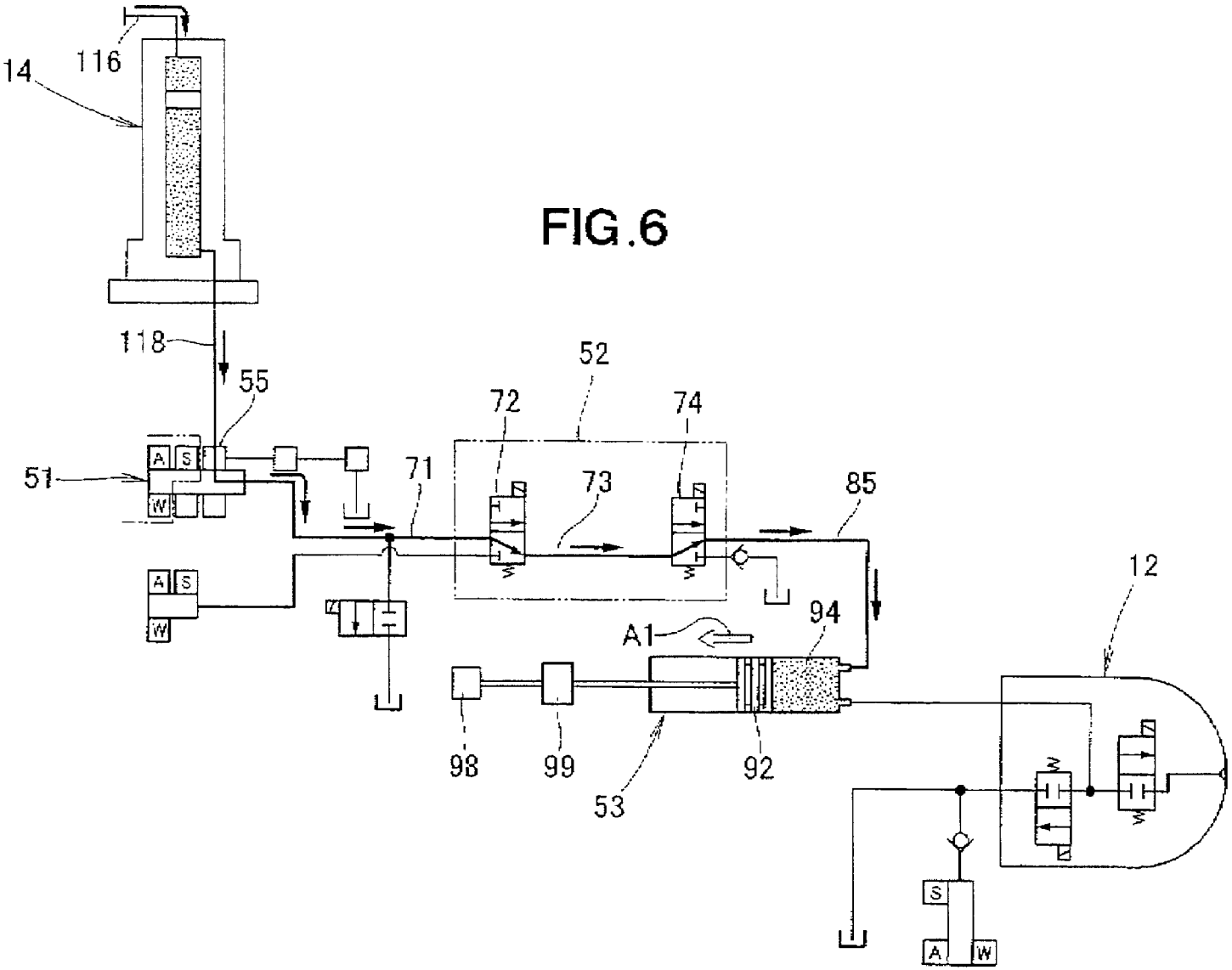
FIG. 6 is a view showing a state in which a storage tank is filled with the electrically conductive paint.

FIG. 6 shows a state in which a storage tank 53 is filled with the paint.

Once the feed channel 71 has been filled with the electrically conductive paint, water or air is fed to the fluid channel 116 with the first and second switching valves 72 and 74 of the block valve mechanism 52 in an open state, the electrically conductive paint that is within the paint cartridge 14 is forced out, the servo motor 98 of the storage tank 53 is driven in order to move the piston 92 in direction A1, and the electrically conductive paint is channeled in the direction indicated by an arrow B to fill the feed channels 73, 85 and the cylinder chamber 94 of the storage tank 53.

Figure 7:
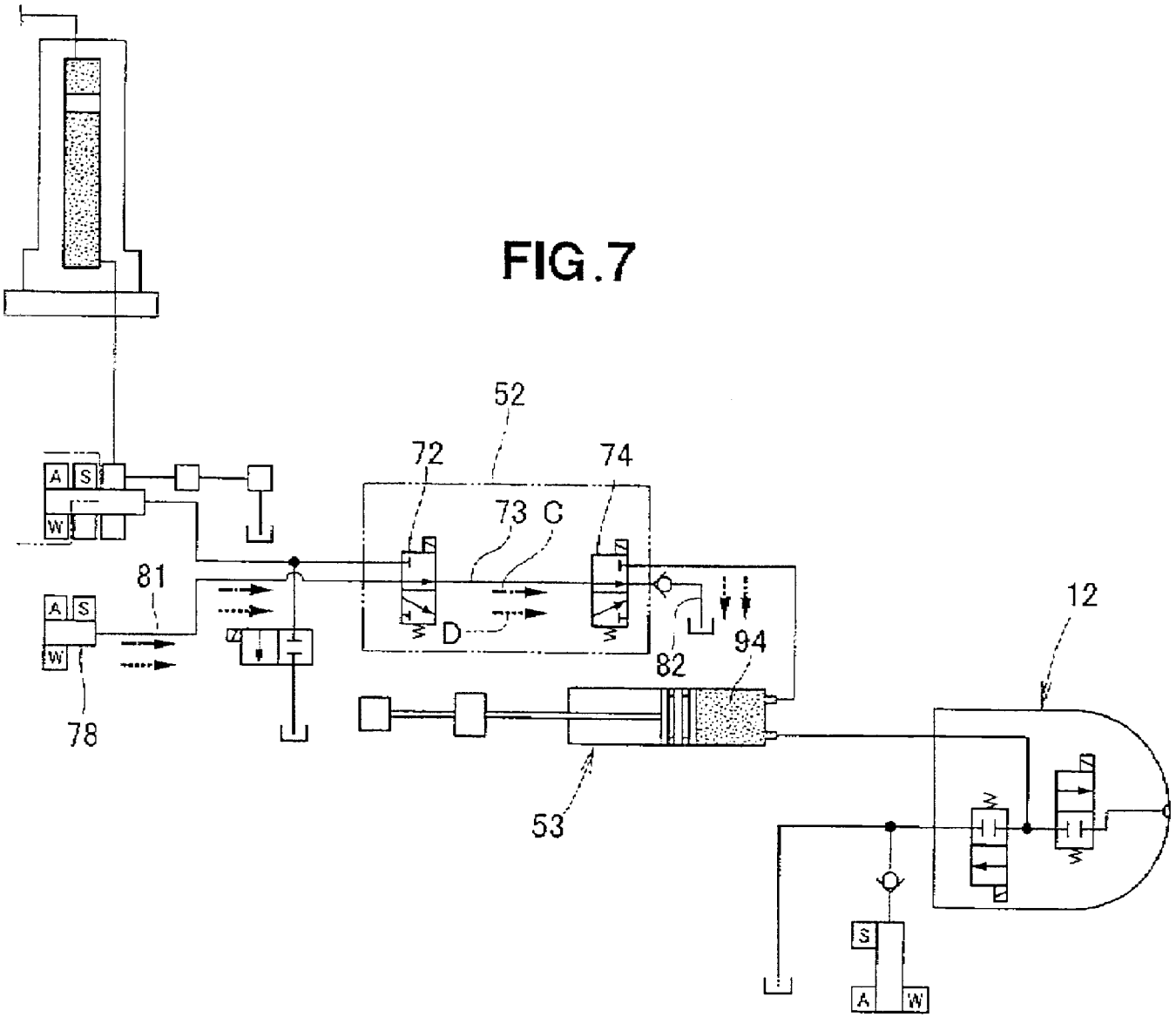
FIG. 7 is a view showing a state in which the interior of a block valve mechanism is cleaned and dried in order to insulate the interior of the block valve mechanism.

FIG. 7 shows a state in which the interior of a block valve mechanism 52 is cleaned and dried in order to insulate the interior of the block valve mechanism 52

Once the cylinder chamber 94 of the storage tank 53 has finished being filled with the electrically conductive paint, the pathways of the first and second switching valves 72, 74 of the block valve mechanism 52 are switched, the second cleaning valve 78 is opened, the cleaning liquid is supplied from the second cleaning valve 78 to the feed channel 73 as indicated by an arrow C, and the feed channel 73 is cleaned. The resulting waste liquid is discharged from the second discharging channel 82. The feed channel 73 is then dried by supplying air from the second cleaning valve 78 to the feed channel 73 as indicated by an arrow D. As a result, the switching valves 72, 74 are electrically insulated against each other.

Figure 8:
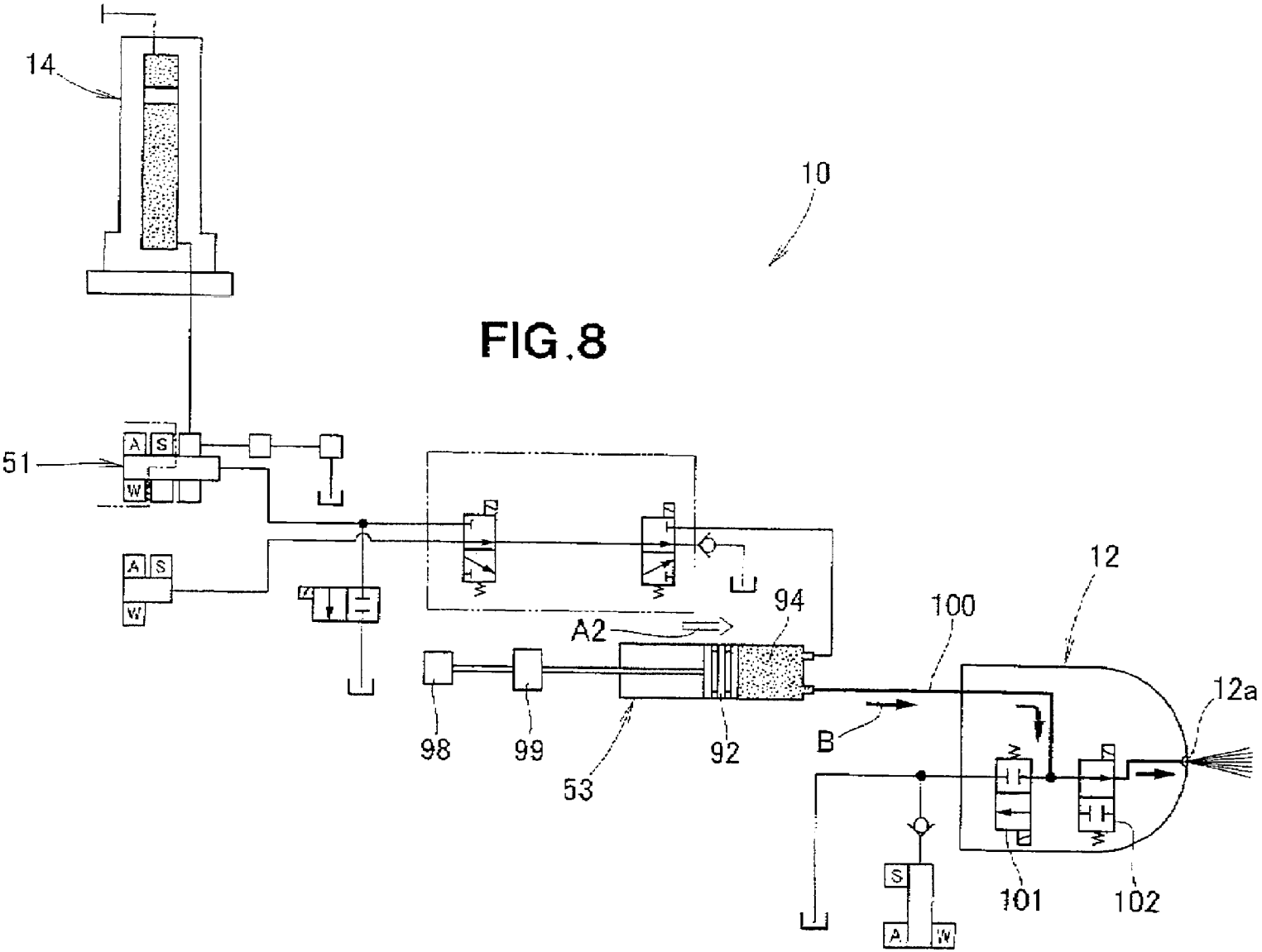
FIG. 8 is a view showing a state in which the electrically conductive paint inside the storage tank is applied using a painting gun.
Figure 9:
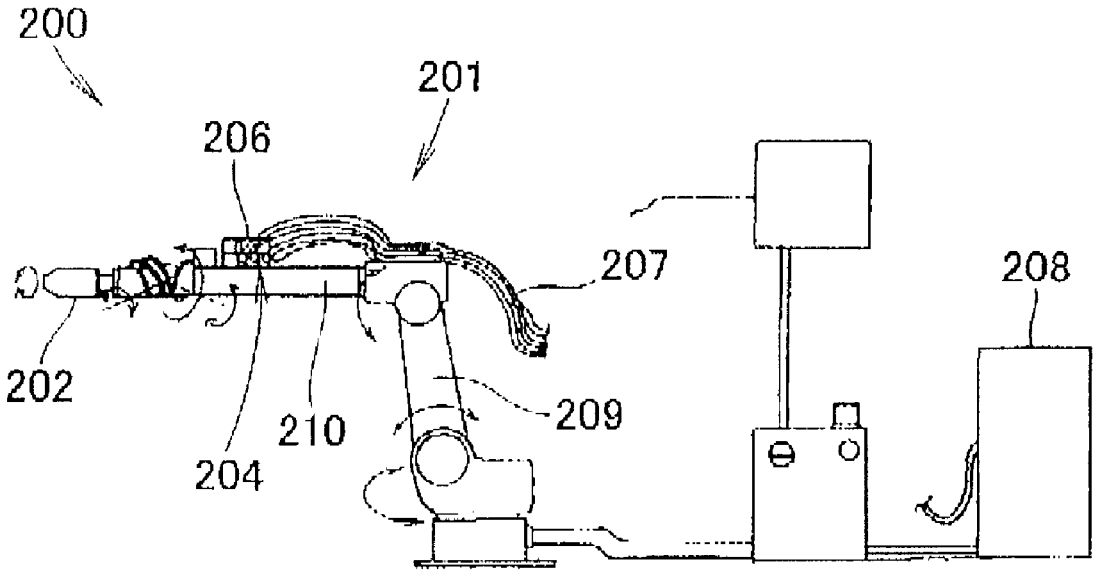
FIG.9 (PRIOR ART)
FIG. 9 is a view showing a conventional coating apparatus.

FIG. 8 shows a state in which the electrically conductive paint inside the storage tank is applied.

The trigger valve 102 is opened, the servo motor 98 is driven, and the piston 92 is moved in a direction indicated by an arrow A2, whereby the electrically conductive paint is pushed from the cylinder chamber 94 into the delivery channel 100. The electrically conductive paint is thereby caused to pass through the trigger valve 102 as indicated by arrow B, and is ejected from the ejection hole 12*a*. At the same time, a high voltage is applied to the electrically conductive paint, and an object to be painted (not shown) is electrostatically painted.

As described above, in the present embodiment, using the phototube 56 to measure the flow rate of the electrically conductive paint within the fluid pathway 122, whose pathway is short, makes it possible to minimize the extent to which the speed at which the fluid pathway 122 is filled will be affected by the viscosity of the electrically conductive paint and the ambient temperature, and improve the accuracy with which the volume in which the electrically conductive paint flows is measured.

Therefore, when air is to be expelled during color changing the quantity of the electrically conductive paint to be used to fill the main paint feed channel 108 with a long pathway can be estimated with a high degree of accuracy based on the flow rate measurement result, allowing the quantity of electrically conductive paint used to fill the main paint feed channel 108 to be maintained at a constant level.

The stopping valve 57 for stopping the flow of electrically conductive paint is provided between the phototube 56 and the discharge channel 58; therefore, the stopping valve 57 can prevent the paint from being discharged through the discharging channel 58, even when the paint leaks from the paint valve 55.

An example in which the phototube 56 is used as a flow rate measuring device is shown in the present embodiment. However, this arrangement is not provided by way of limitation, and another form of flow rate measuring device may be used.

Electrostatic painting according to the present invention is suitable for painting automotive vehicles.

Obviously, various minor changes and modifications of the present invention are possible in light of the above teaching. It is therefore to be understood that within the scope of the appended claims the invention may be practiced otherwise than as specifically described.

What is claimed is:

1. In an electrostatic painting in which an electrically conductive paint is supplied from a plurality of paint feed sections to a color changing valve mechanism, a paint feed channel and a painting gun, a method for continuing the electrostatic painting with the electrically conductive paint changed to a separate electrically conductive paint of different color, comprising the steps of:

switching a paint valve connected to the color changing valve mechanism such that a first pathway of the paint valve is placed in communication with a paint cartridge that is connected to the paint valve, and a second pathway of the paint valve is placed in communication with a discharging channel of a fluid pathway connected to the paint valve, the fluid pathway being shorter than the paint feed channel;

discharging the electrically conductive paint from the paint cartridge into the discharging channel of the fluid pathway;

measuring a rate at which the electrically conductive paint flows into the discharging channel;

switching the paint valve so that the paint cartridge communicates with the paint feed channel via a third pathway of the paint valve; and filling the paint feed channel with a specified quantity of the electrically conductive paint from the paint cartridge in accordance with a result of the flow rate measurement, in order to expel air from an interior of the paint feed channel.

2. An electrostatic painting apparatus comprising:

a paint feed channel for supplying an electrically conductive paint from a plurality of paint feed sections to a painting gun;

a color changing valve mechanism for switching a color of the electrically conductive paint, the color changing valve mechanism being provided to the paint feed channel so as to connect to the paint feed sections;

a reservoir, provided to the paint feed channel closer to the painting gun than the color changing valve mechanism, for temporarily storing the electrically conductive paint and propelling the stored electrically conductive paint towards the painting gun;

an insulating section, provided to the paint feed channel, for electrically insulating the reservoir from the paint feed sections; and a fluid pathway provided to the color changing valve mechanism so as to face the paint feed sections, wherein the fluid pathway comprises:

a paint valve connected to the color changing valve mechanism;

a paint cartridge connected to the paint valve;

a discharging channel capable of discharging the electrically conductive paint from the paint cartridge; and a flow rate measurement device for measuring the volume of flow of the electrically conductive paint when the electrically conductive paint flows through the discharging channel;

the paint valve comprises:

a first pathway connected to the paint cartridge;

a second pathway connected to the discharging channel; and a third pathway connected to the color changing valve mechanism, the paint valve being capable of switching between a flow channel that flows from the paint cartridge to the discharging channel and a flow channel that flows from the paint cartridge to the color changing valve mechanism, and the flow rate measurement device, when the color of the electrically conductive paint is to be switched, measures the flow rate of electrically conductive paint when a determination is to be made of the quantity of electrically conductive paint to fill the paint feed channel in order for air to be expelled from the paint feed channel.

3. The apparatus of claim 2, wherein the fluid pathway further comprises a stopping valve provided between the flow rate measurement device and the discharging channel.

4. The apparatus of claim 2, wherein the painting gun is held by a painting robot, a paint cartridge installation section is provided to a base that is provided to the painting robot, and the paint cartridge is detachably installed in the paint cartridge installation section.

* * * * *